United States Patent [19]

Chason

[11] Patent Number: 5,019,003

[45] Date of Patent: May 28, 1991

[54] FIELD EMISSION DEVICE HAVING PREFORMED EMITTERS

[75] Inventor: Marc K. Chason, Schaumburg, Ill.

[73] Assignee: Motorola, Inc., Schaumburg, Ill.

[21] Appl. No.: 414,505

[22] Filed: Sep. 29, 1989

[51] Int. Cl.[5] ..... H01J 9/02

[52] U.S. Cl. ..... 445/24; 313/309; 427/77

[58] Field of Search ..... 445/24, 25, 50, 52; 313/309; 427/77

[56] References Cited

U.S. PATENT DOCUMENTS

| | | | |
|---|---|---|---|
| 2,189,340 | 2/1940 | Donal, Jr. | 445/52 |
| 3,562,881 | 2/1971 | Barrington et al. | 445/49 |
| 3,720,985 | 3/1973 | Buescher | 427/78 X |
| 3,731,131 | 5/1973 | Kupsky | 313/584 X |
| 3,755,704 | 8/1973 | Spindt et al. | 313/309 |
| 3,783,325 | 1/1974 | Shelton | 313/309 X |
| 3,789,471 | 2/1974 | Spindt et al. | 445/52 |
| 3,812,559 | 5/1974 | Spindt et al. | 445/52 |
| 3,894,332 | 7/1975 | Nathanson et al. | 357/30 |
| 3,921,022 | 11/1975 | Levine | 313/309 |
| 3,970,887 | 7/1976 | Smith et al. | 313/309 |
| 3,998,678 | 12/1976 | Fukase et al. | 427/77 |
| 4,008,412 | 2/1977 | Yuito et al. | 313/309 |
| 4,178,531 | 12/1979 | Alig | 313/309 |
| 4,307,507 | 12/1981 | Gray et al. | 313/309 X |
| 4,345,181 | 8/1982 | Shelton | 313/309 |
| 4,513,308 | 4/1985 | Greene et al. | 313/309 X |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,857,799 | 8/1989 | Spindt et al. | 313/309 X |
| 4,874,981 | 10/1989 | Spindt | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: Flat Cold-Cathode CRTs, by Ivor Brodie, Information Display 1/89.

Field-Emitter Arrays Applied to Vacuum Flourescent Display, by Spindt et al. Jan. 1989 Issue of IEEE Transactions on Electronic Devices.

Field Emission Cathode Array Development for High--Current Density Applications by Spindt et al., dated Aug. 1982, vol. 16 of Applications of Surface Science.

*Primary Examiner*—Kenneth J. Ramsey

*Attorney, Agent, or Firm*—Steven G. Parmelee

[57] ABSTRACT

A field emitting device having a plurality of preformed emitter objects. The emitter objects include sharp geometric discontinuities, and a significant number of these geometric discontinuities are oriented in a way that supports desired field emission activity. Field emission devices built with such emitters can be utilized to provide a flat display screen.

13 Claims, 1 Drawing Sheet

FIELD EMISSION DEVICE HAVING PREFORMED EMITTERS

TECHNICAL FIELD

This invention relates generally to solid state field emission devices.

BACKGROUND OF THE INVENTION

Field emission phenomena is known. Vacuum tube tehnology typically relied upon field emission as induced through provision of a heated cathode (i.e., thermionic emission). More recently, solid state devices have been proposed wherein field emission activity occurs in conjunction with a cold cathode. The advantages of the latter technology are significant, and include rapid switching capabilities, resistance to electromagnetic pulse phenomena, and as a primary component of a flat screen display.

Notwithstanding the anticipated advantages of solid state field emission devices, a number of problems are currently faced that inhibit wide spread application of this technology. One such problem relates to unreliable manufacturability of such devices. Current non-planar oriented configurations for these devices require the construction, at a microscopic level, of emitter cones. Developing a significant plurality of such cones, through a layer by layer deposition process, is proving a significant challenge to today's manufacturing capability. Planar configured devices have also been suggested, which device will apparently be significantly easier to manufacture. Such planar configurations, however, will not likely be suited for some hoped for applications, such as flat screen displays.

Accordingly, a need exits for a field emission device that can be readily manufactured using known manufacturing techniques, and that yields a device suitable for application in a variety of uses.

SUMMARY OF THE INVENTION

These needs and others are substantially met through provision of the field emission device disclosed herein. A field emission device constructed in accordance with the invention includes a substrate having a plurality of preformed emitters disposed on the substrate, such that at least some of the emitters contact the substrate.

In one embodiment of the invention, these emitters are retained in position and are electrically coupled one to the other by a conductive, coupling medium, such as an appropriate metal. Depending upon the embodiment desired, the preformed emitters may be made substantially identical to one another, or may be geometrically dissimilar. In either embodiment, however, the preformed emitters include geometric discontinuities. The geometric discontinuities, when properly oriented with respect to a collector, are best suited to support field emission activity.

BEST MODE FOR CARRYING OUT THE INVENTION

Figure 1:
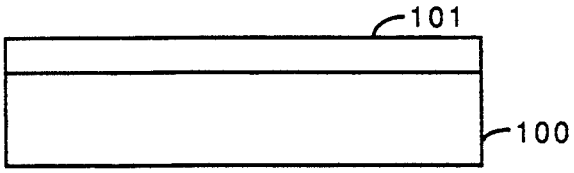
FIG. 1 comprises a side elevation view of a substrate having a retaining medium disposed thereon.
Figure 2:
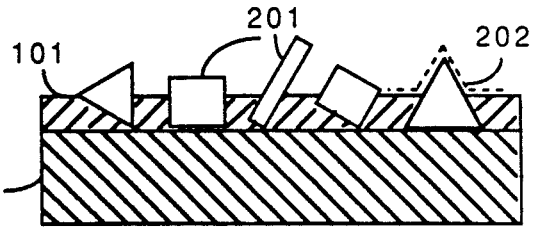
FIG. 2 comprises a side elevational sectioned view of the structure depicted in FIG. 1 and further including preformed emitters configured therewith.

A field emitting device constructed in accordance with the invention may have a support substrate (100) as depicted in FIG. 1. This substrate (100) may be constructed of insulating or conductive material, as appropriate to a particular application. If constructed of insulating material, then the substrate (100) will likely have a plurality of conductive traces formed on the emitter bearing surface thereof. This substrate (100) will have bonding agent (101) (such as metal) disposed thereon. As depicted in FIG. 2, this bonding agent (101) functions to physcially couple a plurality of conductive objects (201) to the substrate (100). Presuming the bonding layer (101) has a thickness of approximately 0.5 microns, and the objects have a length or other major dimension of approximately 1.0 micron, some portion of a significant number of the objects (201) will remain exposed. Further, statistically, a significant number of these objects (201) will be oriented with at least one geometric discontinuity oriented in a preferred direction (in the embodiment depicted in FIG. 2, the preferred direction would be upwardly).

So oriented, and presuming that the objects (201) are comprised of an appropriate material, such as molybdenum or a titanium carbide substance, these objects (201) will function as emitters in the resulting field emission device. As an alternative embodiment, the objects (201) could themselves be comprised of an insulating material, and a thin layer (a few hundred angstroms) of conductive material (202) is disposed thereover to again form the desired emitters. In either embodiment, the effective conductive material should have the appropriate desired properties (i.e., the material should have a low electron work function, and should be conductive). In addition, it is particularly useful that the material comprising the objects (201 or 202) have crystalographically sharp edges, since these sharp edges are the geometric discontinuities that contribute significantly towards facilitating the desired field emission activity.

The objects (201) may either be dispersed pursuant to the predetermined pattern, or substantially randomly. In either case, the particle disbursement should be sufficiently dense that, statistically, an acceptable likelihood exists of a sufficient number of properly oriented geometric discontinuities are available to support the desired field emission activity.

Figure 3:
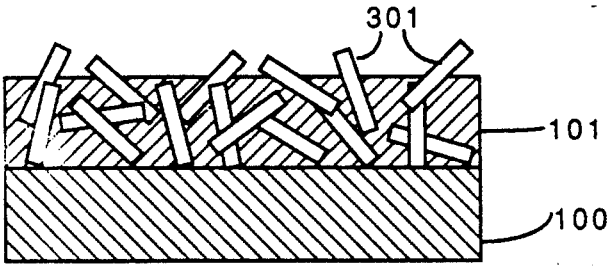
FIG. 3 comprises a side elevational sectioned view of an alternative embodiment constructed in accordance with the invention.

FIG. 3 depicts yet another embodiment constructed in accordance with this invention. In this embodiment, the bonding layer (101) will likely be comprised of an insulating material (though in an appropriate embodiment, a conductor could be used), and this material when deposited on the substrate (100) will already contain a plurality of conductive objects (301). The density of the objects (301) within the bonding agent (101) will be sufficiently high that at least some of the objects (301) will contact the substrate. In addition, a significant number of the objects (301) that contact the substrate (100) will also contact other objects (301), until finally at least some of the objects (301) that extend past the upper surface of the bonding layer (101) will have a conductive path to the surface of the substrate (101). As in the previously described embodiments, statistically, a significant number of the objects (301) will be oriented such that a geometric discontinuity will be positioned to enhance an intended field effect phenomena.

To expose some of the objects (301) as depicted, an etching process may be utilized to remove bonding agent material from around the objects (301) in the desired area.

Figure 4:
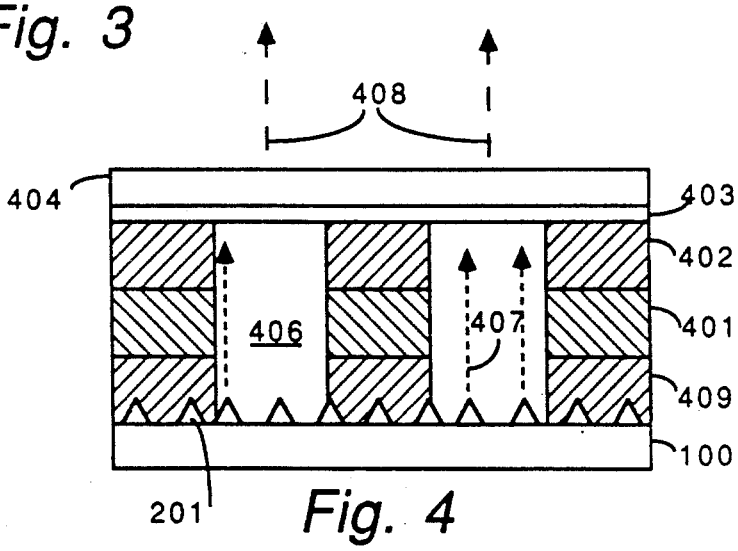
FIG. 4 comprises a side elevational partially sectioned view of a flat screen display constructed in accordance with the invention.

So configured, a field emission device can be constructed by the additional provision of an appropriate collector (anode) and gate (the later appropriate to a triode geometry). One example of a particularly useful embodiment including the invention will now be described in reference to FIG. 4.

In this embodiment, the substrate (100) supporting the plurality of predefined shaped emitter objects (201) has a layer of insulating material (409) formed thereon. Preferably, the material deposition step makes use of an appropriate mask to ensure that groups of emitter objects (201) in predetermined areas will be left free of material.

A conductive layer (401) is then formed atop the insulating layer (409), which layer functions as a gate to effectuate modulation of the resultant electron flow in the completed field emission device. Another insulating layer (402) is then deposited upon the conductive layer (401), with the latter structure then being coupled to a transparent screen (404) comprised of glass, plastic, or other suitable material.

The screen (404) has disposed thereon an appropriate conductive material, such as indium-tin-oxide or thin aluminum, to serve as anodes for the resulting field emission devices. The conductive material will preferably be disposed on the screen (404) in an appropriate predetermined pattern that corresponds to the pixels that will support the desired display functionality. This condutor bearing screen (404) then has a layer of luminescent or cathodoluminescence material (403) disposed thereon and presented towards the emitter objects (201).

The screen (404) may be coupled to the structure described above using appropriate solder type systems, electrostatic bonding techniques, or other suitable coupling mechanisms. This coupling process will preferably occur in a vacuum, such that the resulting encapsulated areas (406) will be evacuated.

So configured, appropriate energization and modulation of the various emitter objects (201) will result in field emission activity. This activity will produce electrons (407) that contact the anode. This activity will in turn cause the phosphor material corresponding to that anode to become luminescent and emit light (408) through the display screen (404). Control of the various field emission devices constructed in this manner will result in the display of a desired pattern on the screen (404).

So configured, the field emission devices comprising the invention can be utilized to construct a narrow, flat display screen.

What is claimed is:

1. A method of forming a field emission device, comprising the steps of:

(A) providing a substrate;

(B) providing a plurality of preformed objects, on the substrate, wherein:

(i) at least some of the preformed objects comprise emitters: and (ii) at least some of the preformed objects are comprised of non-conductive material.

2. The method of claim 1 wherein at least some of the preformed objects that comprise emitters include at least one geometric discontinuity.

3. The method of claim 1 wherein the preformed objects have at least one major dimension of approximately 1 micron.

4. The method of claim 1 wherein the step of providing the plurality of preformed objects on the substrate includes providing a bonding agent on the substrate, and disposing the plurality of preformed objects in contact with the bonding agent.

5. The method of claim 4 wherein the preformed objects have at least one major dimension that is greater than bonding agent on the substrate.

6. The method of claim 4 wherein at least a part of at least some of the preformed objects extends out of the bonding agent.

7: The method of claim 4 wherein at least a part of at least some of the preformed objects extends out of the bonding agent, and wherein at least some of the parts include a geometric discontinuity.

8. The method of claim 1 wherein the step of providing the plurality of preformed objects on the substrate includes the step of disposing the preformed objects in a substantially random pattern on the substrate.

9. The method of claim 1 wherein the step of providing the plurality of preformed objects of the substrate includes the step of disposing the preformed objects in a substantially predetermined pattern on the substrate.

10. The method of claim 1 and further including the step of providing a conductive layer over at least some of the preformed objects.

11. The method of claim 10 wherein at least some of the preformed objects include at least one geometric discontinuity, and wherein the conductive layer conforms substantially in shape to the geometric discontinuity of at least some of the preformed objects.

12. The method of claim 1 and further including the step of operably coupling the emitters to a display screen having at least one anode operably coupled thereto, such that electron emissions from at least some of the emitters will cause emission of light from the display screen.

13. The method of claim 12 wherein the step of operably coupling the emitters to a display screen includes providing a display screen having a substantially transparent conductor formed thereon to serve as the anode.

* * * * *